US005341536A

United States Patent [19]

Hill

[11] Patent Number: 5,341,536

[45] Date of Patent: Aug. 30, 1994

[54] SCRUBBING DEVICE

[76] Inventor: David L. Hill, 397 Hudsondale St., Weatherly, Pa. 18255

[21] Appl. No.: 103,708

[22] Filed: Aug. 10, 1993

[51] Int. Cl.[5] ..... A47L 11/12

[52] U.S. Cl. ..... 15/98; 15/22.1; 15/52.2; 51/175

[58] Field of Search ..... 15/50.2, 52.2, 97.1, 15/98, 22.1, 22.2; 51/175, 170 TL

[56] References Cited

U.S. PATENT DOCUMENTS 1,553,456 9/1925 Metrakos ..... 15/52.2

FOREIGN PATENT DOCUMENTS 284034 11/1952 Switzerland ..... 15/52.2

*Primary Examiner*—Edward L. Roberts

*Attorney, Agent, or Firm*—Joseph W. Molasky & Associates

[57] ABSTRACT

A scrubbing device attachable to rotary power sources comprising a stationary portion, a drive portion, an oscillating portion, and an abrasive portion. Rotary power applied to the drive portion causes the oscillating portion to oscillate linearly allowing the device user to scrub floor surfaces in corners and near adjacent walls.

14 Claims, 5 Drawing Sheets

FIG. 1
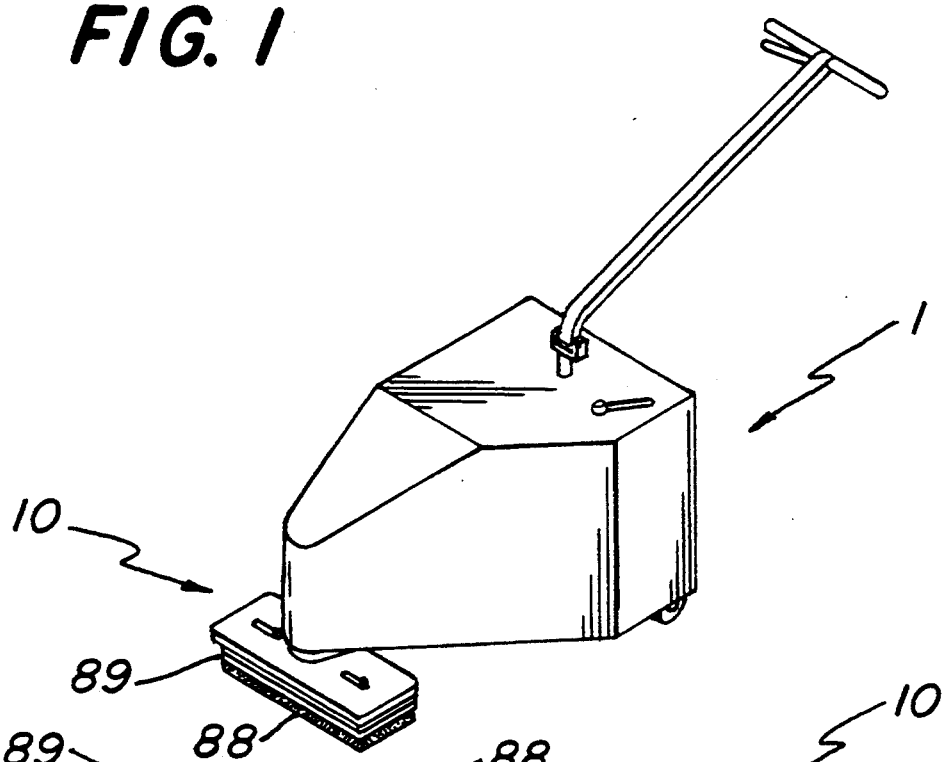
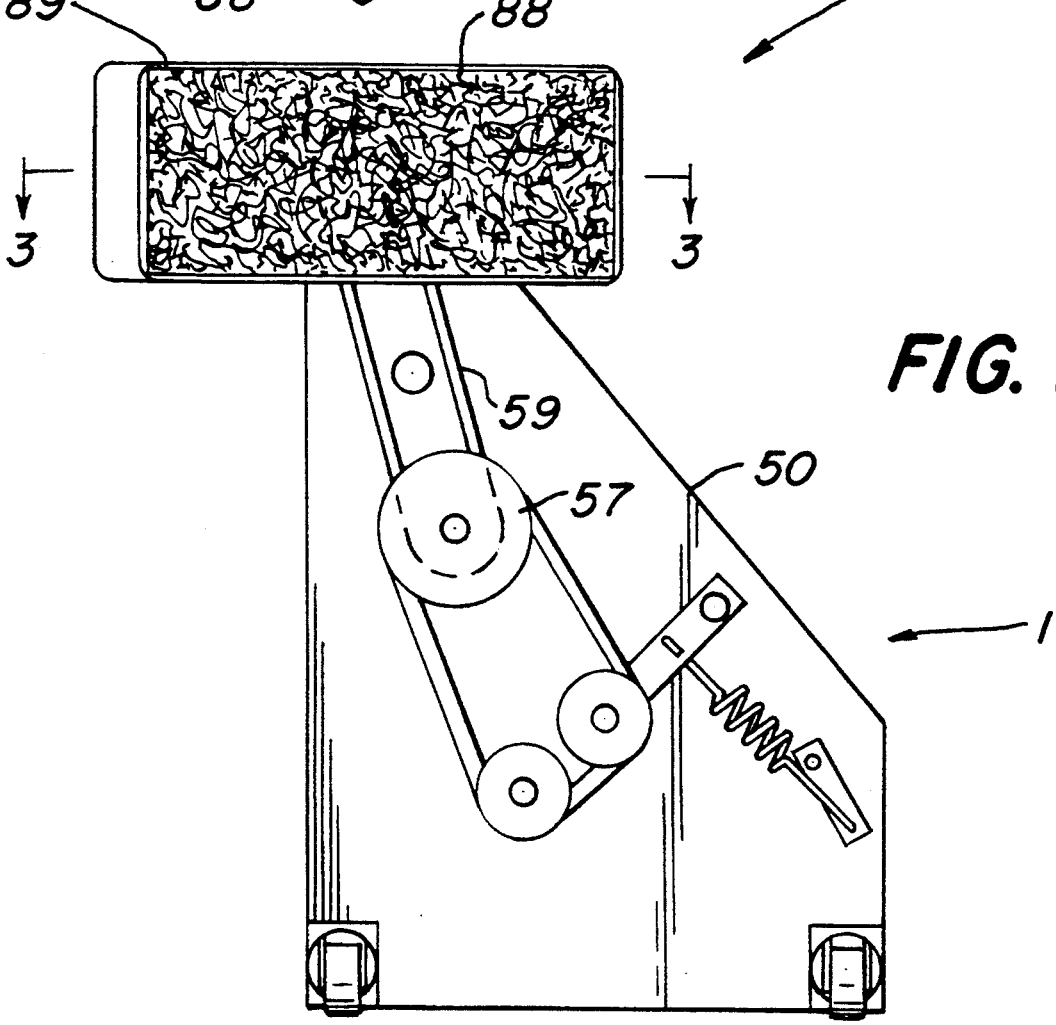
FIG. 2

135
134
136
133
150
137
129
130
128
116
137
127'
116'
10
126
114
147
111
113
115
175
175
115
112
114
121
117
123
118
160
122
124
161
119
163
162
164
169
166
171
172
139
188
176
165
138
170
140
173
167
174
145
176
139
189
146
168

SCRUBBING DEVICE

BACKGROUND OF THE INVENTION

In the field of janitorial services, floors which are not covered by carpet such as tile or linoleum floors are commonly cleaned by using floor cleaning machines. Cleaning machines provide rotary power to circular disks having specialized pads for removing both soil and wax from floor surfaces. The cleaning activities, sometimes called "stripping", "washing", "resurfacing", etc. involve hard rubbing of floor surfaces by a pad to achieve some form of floor treatment. These activities can be collectively called "scrubbing". Circular disks work well to scrub floors in open areas, however, the use of circular disks to scrub floors along walls and in corners suffers from several disadvantages. Scrubbing floors with circular disks, powered by cleaning machines, requires strength, skill, and dexterity to control the cleaning machines due to the machine vibration and due to the difficulty of aligning the arcuate edges of circular disks with the straight edges of adjacent walls. It is therefore a common problem that cleaning machine users often damage walls and baseboards when scrubbing floors with circular disks. It is also very difficult for cleaning machine users to clean floors in the corners of adjacent walls due to the difficulty of controlling the cleaning machines and the circular disks not fitting into the apexes of floor corners.

Therefore, a need exists for a device which will allow the users of floor cleaning machines to scrub in the corners of floors and to scrub floors near walls without marring the adjoining walls.

SUMMARY OF THE INVENTION

It is an object of this invention to provide a device which will allow floor cleaning machine users to scrub floor corners and floors near walls without marring the adjoining walls.

To achieve the foregoing and in accordance with the purposes of the present invention as embodied and broadly described herein, the present invention provides a scrubbing device attachable to a rotary power source comprising a stationary portion, a drive portion attached to said stationary portion, an oscillating portion attached to said stationary portion, and an abrasive portion attached to said oscillating portion.

In one characterization of the present invention, said stationary portion comprises a stationary plate having an orifice, a seating cavity adjacent said orifice, and a plurality of oblong slots; and a plurality of posts slidably disposed within said slots. Said drive portion comprises a shaft, said shaft disposed within said orifice of said stationary plate; a cam, attached to said shaft, and said cam seated in said seating cavity of said stationary plate; a rod attached to said cam, offset from said shaft; and a bearing having a cavity, said rod disposed within said cavity of said bearing. Said oscillating portion comprises an oscillating plate attached to said posts of said stationary portion; said oscillating plate having at least one straight edge for scrubbing along walls and said oscillating plate having at least one corner having an angle of 90° or less for scrubbing in corners, a slot means, having an oblong slot, attached to said oscillating plate, said bearing of said drive portion seated in said slot; and abrasive portion attachment means attached to said oscillating plate. Said abrasive portion attached to said abrasive portion attachment means of said oscillating portion.

Another characterization of the present invention provides a scrubbing device attachable to a rotary power source comprising a stationary portion comprising a stationary plate having an orifice, a seating cavity adjacent said orifice, a plurality of oblong slots, and a plurality of skid plates, said stationary portion also comprised of a plurality of posts, slidably disposed within said slots. The device further comprises a drive portion comprising a shaft having a top end and a bottom end, said shaft rotatably disposed within said orifice of said stationary plate, a cam having a top side and a bottom side, said top side of said cam attached to said bottom end of said shaft, and said cam seated in said seating cavity of said stationary plate; a rod attached to said bottom side of said cam offset from said shaft; a bearing having a cavity, said rod rotatably disposed within said cavity of said bearing; a pulley attached to said shaft; a washer attached to said shaft, said washer positioned between said stationary plate and said pulley; a housing tangent to said top end of said shaft, said housing mountable on said rotary power source; and a split-ring washer attached to said shaft, said split-ring washer positioned between said housing and said rotary power source. The device further comprises an oscillating portion comprising an oscillating plate removably attached to said posts of said stationary portion, said oscillating plate having at least one straight edge for scrubbing along walls and said oscillating plate having at least one corner having an angle of 90° or less for scrubbing in corners; a slot means having an oblong slot attached to said oscillating plate, said bearing of said drive portion seated in said slot; abrasive portion attachment means attached to said oscillating plate, and a plurality of skid plates attached to said oscillating plate, said plurality of oscillating plate skid plates positioned adjacent said plurality of stationary plate skid plates. The device further comprises an abrasive portion removably attached to said abrasive portion attachment means of said oscillating portion.

In yet another characterization of this invention, said stationary portion comprises a stationary plate having an orifice, a first seating cavity adjacent said orifice, a second seating cavity adjacent said first seating cavity, a plurality of oblong slots, and a plurality of posts slidably disposed in said slots. Said drive portion comprises a shaft disposed within said orifice of said stationary plate; a cam attached to said shaft, said cam seated in said first seating cavity of said stationary plate; a rod attached to said cam, offset from said shaft, and a crank attached to said rod and attached to one of said posts of said stationary portion, said crank seated in said second seating cavity of said stationary plate. Said oscillating portion comprises an oscillating plate attached to said posts of said stationary portion, said oscillating plate having a first seating cavity adjacent said rod of said drive portion, said oscillating plate having a second seating cavity adjacent said crank of said drive portion, said oscillating plate having at least one straight edge for scrubbing along walls and said oscillating plate having at least one corner having an angle of 90° or less for scrubbing in corners, and abrasive portion attachment means attached to said oscillating plate. Said abrasive portion is attached to said abrasive portion attachment means of said oscillating portion.

Another characterization of the present invention provides a scrubbing device attachable to a rotary power source comprising a stationary portion comprising a stationary plate having an orifice, a first seating cavity adjacent said orifice, a second seating cavity adjacent said first seating cavity, a plurality of oblong slots, and a plurality of skid plates, said skid plates having a longitudinal rail, and a plurality of posts, slidably disposed within said slots. The device further comprises a drive portion comprising a shaft having a top end and a bottom end, said shaft rotatably disposed within said orifice of said stationary plate; a cam having a top side and a bottom side, said top side of said cam attached to said bottom end of said shaft, and said cam seated in said first seating cavity of said stationary plate; a rod attached to said bottom side of said cam offset from said shaft; a bearing attached to said rod; a crank attached to said bearing, said crank attached to one of said posts of said stationary portion, said crank seated in said second seating cavity of said stationary plate; a pulley attached to said shaft; a washer attached to said shaft, said washer positioned between said stationary plate and said pulley; a housing tangent to said top end of said shaft, said housing mountable on said rotary power source; a split-ring washer attached to said shaft, said split-ring washer positioned between said housing and said rotary power source. The device further comprises an oscillating portion comprising an oscillating plate attached to said posts of said stationary portion, said oscillating plate having a first seating cavity adjacent said rod of said drive portion, said oscillating plate having a second seating cavity adjacent said crank of said drive portion, said oscillating plate having at least one straight edge for scrubbing along walls and said oscillating plate having at least one corner having an angle of 90° or less for scrubbing in corners; abrasive portion attachment means attached to said oscillating plate, and a plurality of skid plates attached to said oscillating plate, said plurality of oscillating plate skid plates positioned adjacent said plurality of stationary plate skid plates, said oscillating portion skid plates having longitudinal grooves which slidably engage said stationary portion skid plates, and an abrasive portion removably attached to said abrasive portion attachment means of said oscillating portion.

BRIEF DESCRIPTION OF THE DRAWINGS

The accompanying drawings, which are incorporated in and form a part of the specification, illustrate the embodiments of the present invention and, together with description, serve to explain the principles of the invention.

In the drawings:

FIG. 1 illustrates a perspective view of scrubbing device 10 attached to floor cleaning machine 1;

FIG. 2 illustrates a bottom view of the scrubbing device and the floor cleaning machine illustrated by FIG. 1;

DESCRIPTION OF THE PREFERRED EMBODIMENTS

The scrubbing device of the present invention is shown generally as 10 attached to a floor cleaning machine shown generally as 1 in FIG. 1. Device 10 is attached to cleaning machine 1 by support member 50 and belt 59 shown in FIG. 2. Device 10 is comprised of a stationary portion, a drive portion, an oscillating portion, and an abrasive portion.

Figure 3:
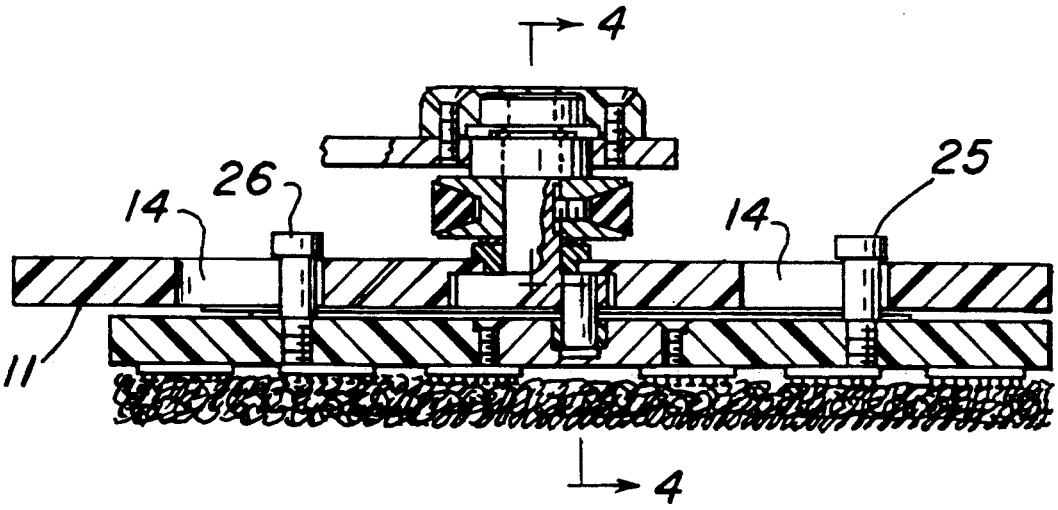
FIG. 3 is a partially cut-away sectional view illustrating device 10 taken along lines 3—3 of FIG. 2.
Figure 5:
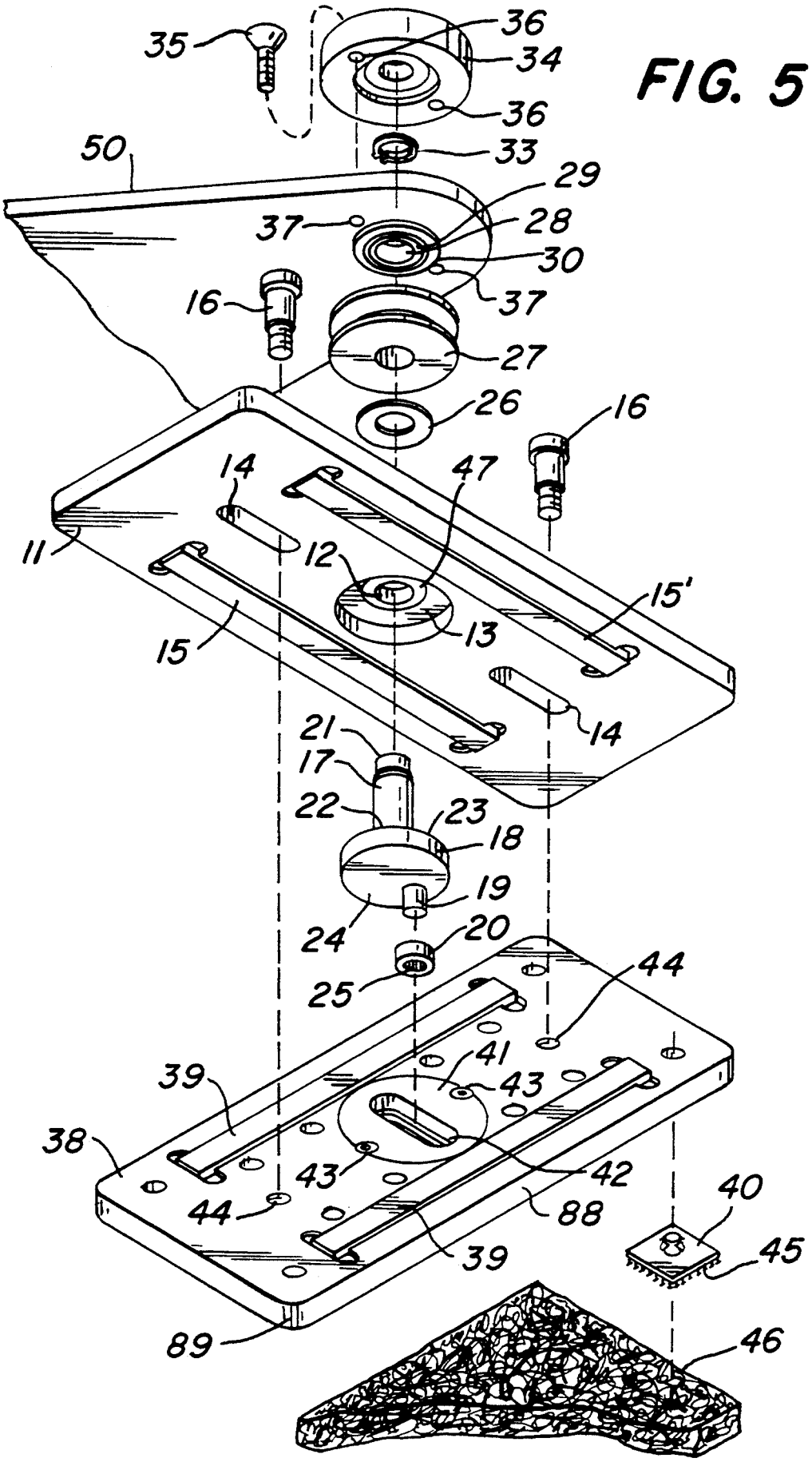
FIG. 5 is a partially cut-away, exploded perspective view illustrating scrubbing device 10.

Referring to FIGS. 3 and 5, the stationary portion comprises a rectangular stationary plate 11 and a plurality of threaded posts 16. Plate 11 has a bushing 47 lining orifice 12, a seating cavity 13 adjacent orifice 12, a plurality of oblong slots 14, and a plurality of skid plates 15. Posts 16 are disposed in slots 14 as shown in FIG. 3.

Figure 4:
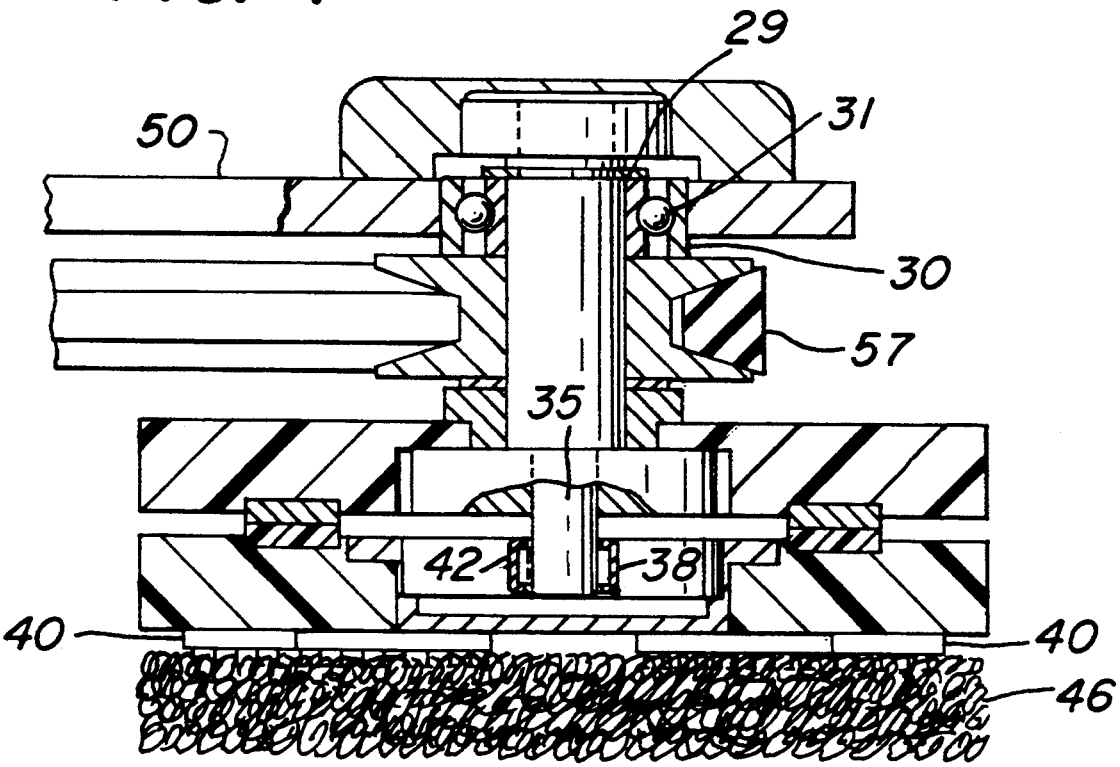
FIG. 4 is a partially cut-away sectional view illustrating device 10 taken along lines 4—4 of FIG. 3.

The drive portion comprises a shaft 17, a cam 18, a rod 19, and a bearing 20 as shown in FIG. 5. Shaft 17 has a top end 21 and a bottom end 22. Cam 18 has a top side 23, and a bottom side 24. Bottom end 22 of shaft 17 is attached to the center of cam top side 23. Rod 19 is attached to cam bottom side 24 at a location offset from the longitudinal axis of shaft 17 and distal from the center of cam bottom side 24 as shown in FIG. 5. Rod 19 is disposed in cavity 25 of bearing 20 as shown in FIGS. 4 and 5. If the device is powered by a belt, the drive portion can further comprise a washer 26 mounted on shaft 17 above stationary plate 11, a pulley 27 mounted on shaft 17 above washer 26 and a housing 34. Shaft 17 is disposed in orifice 28 of exterior grooved ring 29. Exterior grooved ring 29 is positioned adjacent interior grooved ring 30. Interior grooved ring 30 is attached to machine support member 50. Ball bearings 31 are disposed between the grooved rings 29 and 30 as shown in FIG. 4. Split-ring washer 33 is mounted on shaft 17 above support member 50 and the top end 21 of shaft 17 is seated in housing 34. Housing 34 is attached to support member 50 by screws represented by screw 35 in FIG. 5 disposed in housing holes 36 and removably connected to threaded support holes 37.

The oscillating portion comprises rectangular oscillating plate 38 having a plurality of skid plates 39, abrasive portion attachment means 40 and slot means 41 having slot 42. Slot means 41 is a metal member for housing bearing 20 and is attached to plate 38 by screws 43 as shown in FIG. 5. Plate 38 is removably attached to posts 16 of stationary plate 11 by threaded orifices 44 as shown in FIG. 5. Bearing 20 is disposed in slot 42 as shown in FIGS. 4 and 5. Abrasive portion attachment means 40 are a plurality of members for removably attaching the abrasive portion to the oscillating portion such as means 40 having a multitude of hooks 45 as shown in FIGS. 4 and 5.

The abrasive portion is comprised of an abrasive pad attachable to attachment means 40 such as a plastic mesh resurfacing or scouring pad 46. Hooks 45 of attachment means 40 detachably engage the mesh structure of pad 46, thus, attaching pad 46 to oscillating plate 38 as shown in FIGS. 4 and 5.

Scrubbing device 10 is operated by providing rotational power to shaft 17 such as by machine 1 rotating machine pulley 57 and thereby driving belt 59 shown in FIG. 2. Belt 59 rotates pulley 27 which provides rotational power to shaft 17 by rotating shaft 17 about the longitudinal axis of shaft 17. Rotating shaft 17 rotates cam 18 causing rod 19 to rotate within bearing cavity 25 of bearing 20. Since rod 19 is offset from the longitudinal axis of shaft 17, bearing 20 is forced to rotated and slide within slot 42 forcing plate 38 to oscillate back and forth, causing posts 16 to slide back and forth within slots 14 and causing oscillating plate skid plates 39 to slide under stationary plate skid plates 15. Thus, by providing rotary power to shaft 17, plate 38 is forced to oscillate back and forth in a linear motion causing pad 46 to scrub in a linear motion. The device allows the cleaning machine user to align the straight edge 88 shown in FIGS. 1, 2, and 5 of the device's oscillating plate with a straight edge of a wall while applying a linear scrubbing motion to pad 46. The linear motion of plate 38 and pad 46 allows the device user to scrub floors very near adjoining walls while reducing the danger that the floor cleaning machine will mar the adjoining walls. The device also allows the cleaning machine user to align at least one corner of the device's oscillating plate, which has an angle of 90° or less such as corner 89 shown in FIGS. 1, 2, and 5, with the apex of wall corners thus allowing the device user to scrub floors located in the corners of adjoining walls while reducing the danger of marring the adjoining walls.

Figure 6:
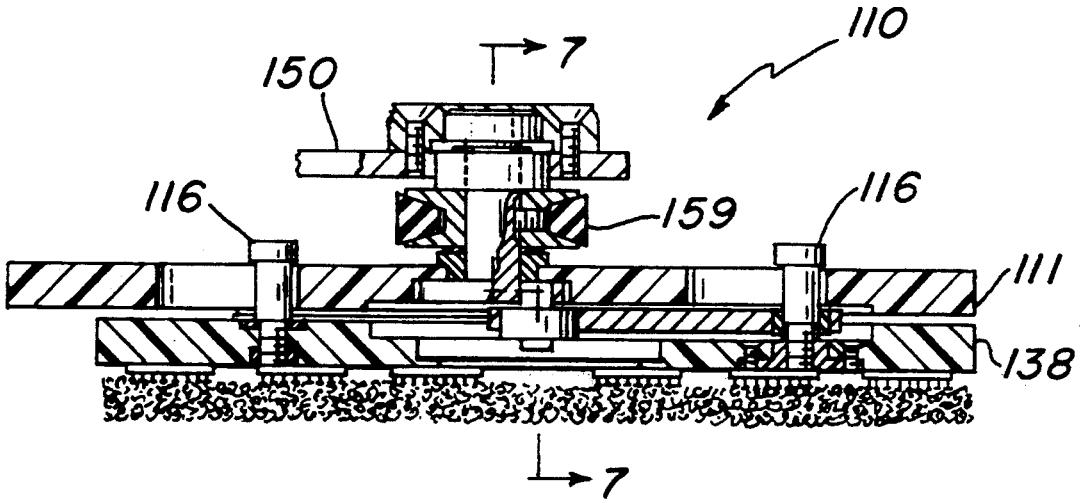
FIG. 6 is a partially cut-away sectional view illustrating device 110.
Figure 7:
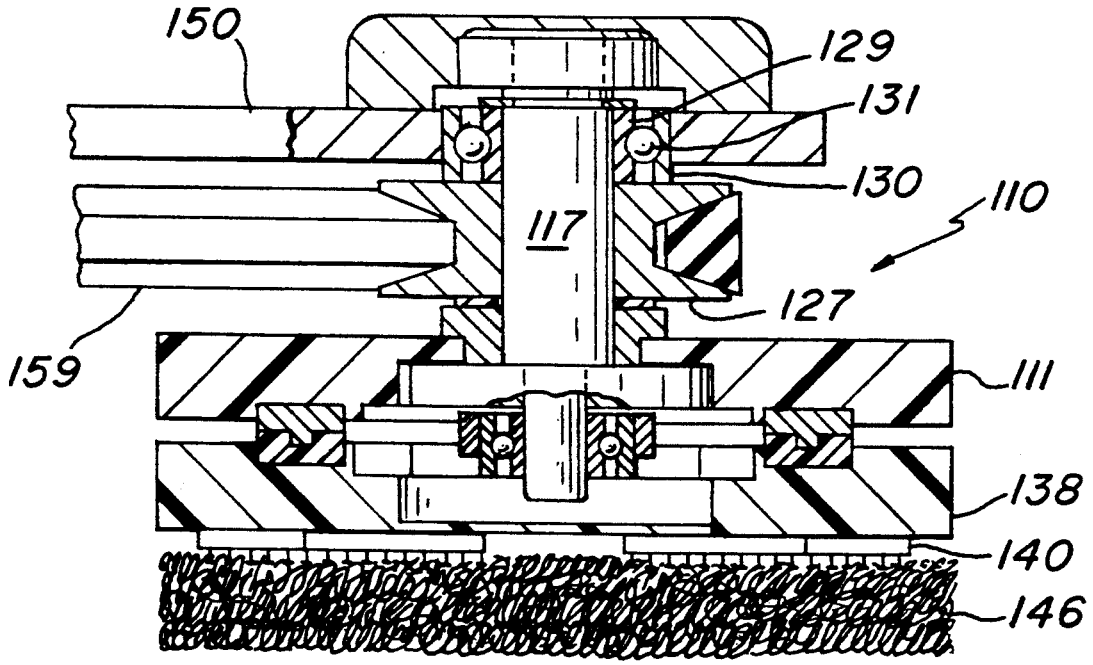
FIG. 7 is a partially cut-away sectional view illustrating device 110 taken along lines 7—7 of FIG. 6.
Figure 8:
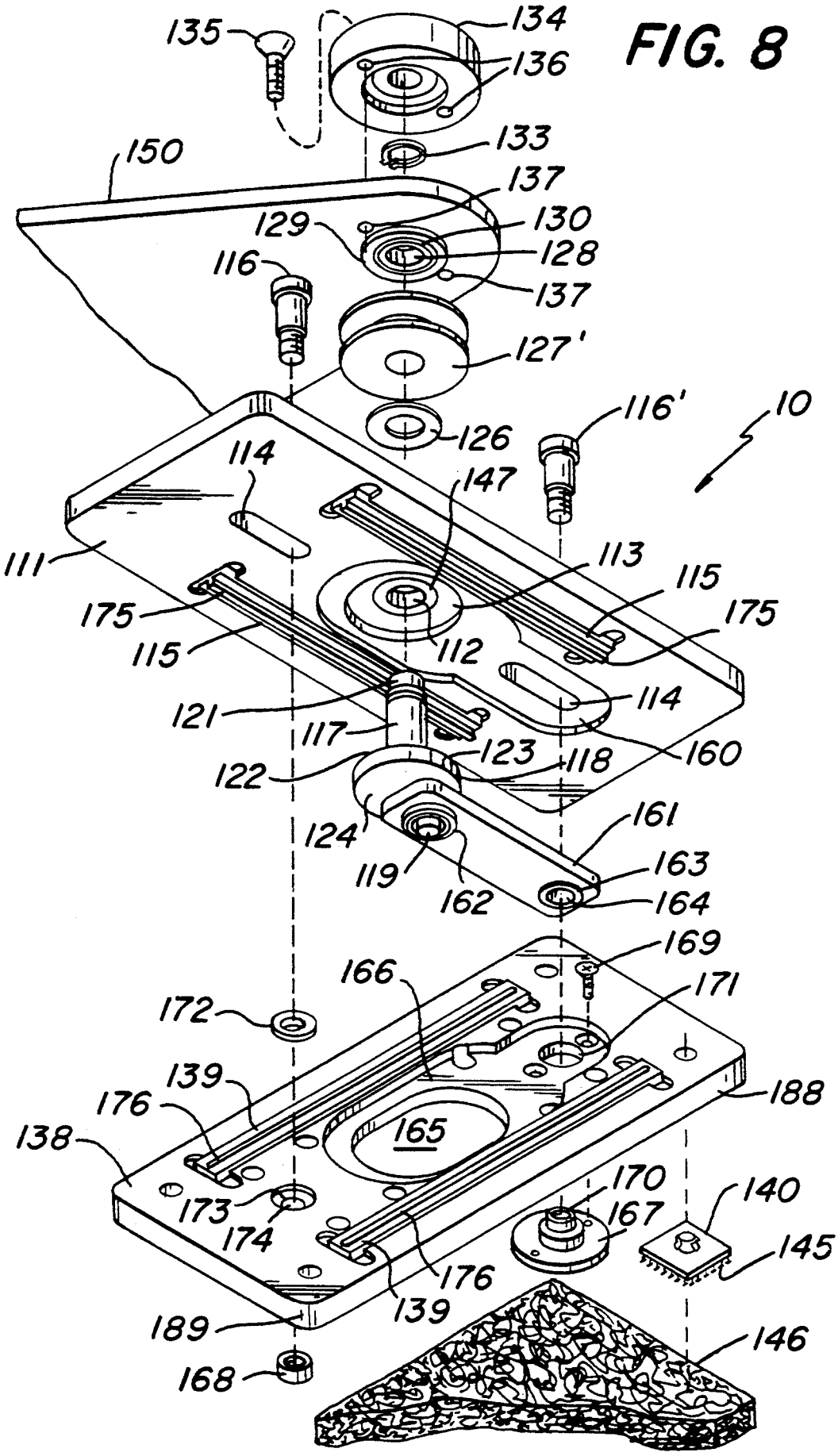
FIG. 8 is a partially cut-away, exploded perspective view illustrating scrubbing device 110.

Another embodiment of the present invention is shown generally as 110 in FIGS. 6–8. Device 110 is comprised of a stationary portion, a drive portion, an oscillating portion and an abrasive portion.

Referring to FIGS. 6, 7, and 8, the stationary portion comprises a rectangular stationary plate 111 and a plurality of threaded posts 116 and 116'. Plate 111 has a bushing 147 lining orifice 112, first seating cavity 113 adjacent orifice 112, a second seating cavity 160 adjacent first seating cavity 113, a plurality of oblong slots 114 and 114' and a plurality of skid plates 115. Posts 116 and 116' are disposed in slots 114 and 114', respectively, as shown in FIG. 8.

The drive portion comprises a shaft 117, a cam 118, a rod 119, and a crank 161 as shown in FIG. 8. Shaft 117 has a top end 121 and a bottom end 122. Cam 118 has a top side 123 and a bottom side 124. Bottom end 122 of shaft 117 is attached to the center of cam top side 123, and rod 119 is attached to cam bottom side 124 at a location offset from said longitudinal axis of shaft 117 and distal from the center of cam bottom side 124 as shown in FIG. 8. Rod 119 is disposed in bearing 162. Bearing 162 is attached to crank 161. Crank 161 is attached to bushing 163 having orifice 164 as shown in FIG. 8. If the drive portion is belt driven, the drive portion can also comprise a washer 126 mounted on a shaft 117 above stationary plate 111, a pulley 127 mounted on shaft 117 above washer 126, and a housing 134. Shaft 117 is disposed in orifice 128 of exterior grooved ring 129. Exterior grooved ring 129 is positioned adjacent interior grooved ring 130. Interior grooved ring 130 is attached to machine support member 150. Ball bearings 131 are disposed between the grooved rings as shown in FIG. 7. Split-ring washer 133 is mounted on shaft 117 above support member 150 and the top end 121 of shaft 117 is seated in housing 134. Housing 134 is attached to support member 150 by screws represented by screw 135, in FIG. 7, disposed in housing holes 136 and removably connected to threaded support holes 137.

The oscillating portion comprises rectangular oscillating plate 138 having a plurality of skid plates 139, abrasive portion attachment means 140, a first seating cavity 165 positioned adjacent rod 119, a second seating cavity 166 positioned adjacent crank 161, pivot post connector 167 and fixed post connector 168. First seating cavity 165 provides a hollow receptacle allowing movement of rod 119. Second seating cavity 166 provides a hollow receptacle allowing movement of crank 161. Pivot post connector 167 attaches to oscillating plate 138 by screws 169 which affix and position threaded orifice 170 of pivot post connector 167 in plate orifice 171. Post 116' is disposed through slot 114' and through bushing orifice 164 and mates with threaded orifice 170 of pivot post connector 167 to secure plate 138 to plate 111 and provide a pivot point for crank 161 as shown in FIG. 8. Plate 138 is also attached to plate 111 by fixed post connector 168. Post 116 is disposed through slot 114, is disposed through washer 172 through washer seat 173 and post orifice 174 and is affixed to fixed post connector 168 as shown in FIG. 8. Abrasive portion attachment means 140 are a plurality of members for attaching the abrasive portion to the oscillating portion such as means 140 having a multitude of hooks 145 as shown in FIGS. 7 and 8.

The abrasive portion is comprised of an abrasive pad attachable to attachment means 140 such as a plastic mesh resurfacing or scouring pad 146. Hooks 145 of attachment means 140 detachably engage the mesh structure of pad 146, thus, attaching pad 146 to oscillating plate 138 as shown in FIGS. 7 and 8.

Scrubbing device 110 is operated by belt 159 rotating pulley 127 which provides rotational power to shaft 117 by rotating shaft 117 about the longitudinal axis of shaft 117. Rotating shaft 117 rotates cam 118 causing rod 119 to rotate within bearing 162. Since rod 119 is offset from shaft 117 as shaft 117 rotates cam 118, rod 119 rotates within bearing 162 causing crank 161 to be pulled in an oscillating motion. Crank 161 pivots about post 116' while forcing both posts 116 and 116' to slide within slots 114 and 114'. Since posts 116' and 116 are affixed to connectors 167 and 168 and posts 116' and 116 are disposed through orifices 171 and 174, plate 138 is forced to oscillate as crank 161 is oscillated. In order to keep plates 111 and 138 in alignment during oscillation, skids 115 have rails 175 which fits into grooves 176 in skids 139. Thus, as plates 138 oscillates, skid grooves 176 slide over rails 175, guiding the oscillation of plate 138 in a linear motion. Thus, by providing rotary power to shaft 117, plate 138 is forced to oscillate in a linear motion causing pad 146 to scrub in a linear motion. The device allows the cleaning machine user to align the straight edge 188 shown in FIG. 8 of the device's oscillating plate with the straight edge of a wall while applying a linear scrubbing motion to pad 146. The linear motion of plate 138 and pad 146 allows the device user to scrub floors very near adjoining walls while reducing the danger that the floor cleaner will mar the adjoining walls. The device also allows the cleaning machine user to align at least one corner which has an angle of 90° or less such as corner 189 shown in FIG. 8 of the device's oscillating plate with the apex of wall corners thus allowing the device user to scrub floors located in the corners of adjoining walls while reducing the danger of marring the adjoining walls.

As will be obvious to one skilled in the art, devices 10 and 110 have been described in the preferred embodiment as being attached to floor cleaning machines which provide rotational power to shafts via a belt. Thus, the housings 36 and 136, screws 35 and 135, washers 33 and 133, pulleys 27 and 127, and machine support members 50 and 150 have been described to clearly illustrate an example of how rotational power is supplied to this invention. However, it is within the scope of this invention that any type of rotational power could be supplied to this device and still remain within the scope of this invention so long as some form of rotational power drives the shaft of the invention's drive portion. Typical drive mechanisms which could be used to drive this invention are flex, friction, and gear drive mechanisms.

Additionally, devices 10 and 110 have been described in the preferred embodiment having rectangular, stationary and oscillating plates. However, it is within the scope of this invention that the stationary and oscillating plates can be of any geometric design so long as the oscillating plate has at least one straight edge for scrubbing along walls and at least one corner having an angle of 90° or less for scrubbing in corners.

While the preferred embodiments have been fully described and depicted for the purposes of explaining the principles of the present invention, it will be appreciated by those skilled in the art that modification, substantiations, and changes may be made thereto without departing from the scope of the invention set forth in the appended claims.

What is claimed is:

1. A scrubbing device attachable to a rotary power source comprising:

a.) a stationary portion comprising:
  1.) a stationary plate having an orifice, a seating cavity adjacent said orifice, and a plurality of oblong slots, and
  2.) a plurality of posts, slidably disposed within said slots, b.) a drive portion comprising:
  1.) a shaft, said shaft disposed within said orifice of said stationary plate,
  2.) a cam attached to said shaft, and said cam seated in said seating cavity of said stationary plate,
  3.) a rod attached to said cam, offset from said shaft, and
  4.) a bearing having a cavity, said rod disposed within said cavity of said bearing, c.) an oscillating portion comprising:
  1.) an oscillating plate attached to said posts of said stationary portion, said oscillating plate having at least one straight edge for scrubbing along walls and said oscillating plate having at least one corner having an angle of 90° or less for scrubbing in corners,
  2.) a slot means, having an oblong slot, attached to said oscillating plate, said bearing of said drive portion seated in said slot, and
  3.) abrasive portion attachment means attached to said oscillating plate, and d.) an abrasive portion attached to said abrasive portion attachment means of said oscillating portion.

2. The scrubbing device of claim 1 wherein said oscillating plate is rectangular.

3. A scrubbing device attachable to a rotary power source comprising:

a.) a stationary portion comprising:
  1.) a stationary plate having an orifice, a seating cavity adjacent said orifice, a plurality of oblong slots, and a plurality of skid plates, and
  2.) a plurality of posts, slidably disposed within said slots, b.) a drive portion comprising:
  1.) a shaft having a top end and a bottom end, said shaft rotatably disposed within said orifice of said stationary plate,
  2.) a cam having a top side and a bottom side, said top side of said cam attached to said bottom end of said shaft, and said cam seated in said seating cavity of said stationary plate,
  3.) a rod attached to said bottom side of said cam offset from said shaft,
  4.) a bearing having a cavity, said rod rotatably disposed within said cavity of said bearing,
  5.) a pulley attached to said shaft,
  6.) a washer attached to said shaft, said washer positioned between said stationary plate and said pulley,
  7.) a housing tangent to said top end of said shaft, said housing mountable on said rotary power source,
  8.) a split-ring washer attached to said shaft, said split-ring washer positioned between said housing and said rotary power source.

c.) an oscillating portion comprising:
  1.) an oscillating plate removably attached to said posts of said stationary portion, said oscillating plate having at least one straight edge for scrubbing along walls and said oscillating plate having at least one corner having an angle of 90° or less for scrubbing in corners,
  2.) a slot means having an oblong slot, attached to said oscillating plate, said bearing of said drive portion seated in said slot,
  3.) abrasive portion attachment means attached to said oscillating plate, and
  4.) a plurality of skid plates attached to said oscillating plate, said plurality of oscillating plate skid plates positioned adjacent said plurality of stationary plate skid plates, and d.) an abrasive portion removably attached to said abrasive portion attachment means of said oscillating portion.

4. The scrubbing device of claim 3 wherein said oscillating plate is rectangular.

5. The scrubbing device of claim 4 wherein said stationary plate is rectangular.

6. The scrubbing device of claim 3 wherein said abrasive portion attachment means are a plurality of members having a multitude of hooks.

7. The scrubbing device of claim 3 wherein said abrasive portion is constructed of plastic mesh.

8. A scrubbing device attachable to a rotary power source comprising:

a.) stationary portion comprising:
  1.) a stationary plate having an orifice, a first seating cavity adjacent said orifice, a second seating cavity adjacent said first seating cavity and a plurality of oblong slots, and
  2.) a plurality of posts slidably disposed in said slots, b.) drive portion comprising:
  1.) a shaft, said shaft disposed within said orifice of said stationary plate,
  2.) a cam, said cam attached to said shaft, and said cam seated in said first seating cavity of said stationary plate,
  3.) a rod attached to said cam, offset from said shaft, and
  4.) a crank attached to said rod and attached to one of said posts of said stationary portion, said crank seated in said second seating cavity of said stationary plate, c.) an oscillating portion comprising:

1.) an oscillating plate attached to said posts of said stationary portion, said oscillating plate having a first seating cavity adjacent said rod of said drive portion, said oscillating plate having a second seating cavity adjacent said crank of said drive portion, said oscillating plate having at least one straight edge for scrubbing along walls and said oscillating plate having at least one corner having an angle of 90° or less for scrubbing in corners, and 2.) abrasive portion attachment means attached to said oscillating plate, and d.) an abrasive portion attached to said abrasive portion attachment means of said oscillating portion.

9. The scrubbing device of claim 8 wherein said oscillating plate is rectangular.

10. A scrubbing device attachable to a rotary power source comprising:

a.) a stationary portion comprising:

1.) a stationary plate having an orifice, a first seating cavity adjacent said orifice, a second seating cavity adjacent said first seating cavity, a plurality of oblong slots, and a plurality of skid plates, said skid plates each having a longitudinal rail and 2.) a plurality of posts, slidably disposed within said slots, b.) a drive portion comprising:

1.) a shaft having a top end and a bottom end, said shaft rotatably disposed within said orifice of said stationary plate, 2.) a cam having a top side and a bottom side, said top side of said cam attached to said bottom end of said shaft, and said cam seated in said first seating cavity of said stationary plate, 3.) a rod attached to said bottom side of said cam offset from said shaft, 4.) a bearing attached to said rod 5.) a crank attached to said bearing, said crank attached to one of said posts of said stationary portion, said crank seated in said second seating cavity of said stationary plate, 6.) a pulley attached to said shaft, 7.) a washer attached to said shaft, said washer positioned between said stationary plate and said pulley, 8.) a housing tangent to said top end of said shaft, said housing mountable on said rotary power source, 9.) a split-ring washer attached to said shaft, said split-ring washer positioned between said housing and said rotary power source.

c.) an oscillating portion comprising:

1.) an oscillating plate attached to said posts of said stationary portion, said oscillating plate having a first seating cavity adjacent said rod of said drive portion, said oscillating plate having a second seating cavity adjacent said crank of said drive portion, said oscillating plate having at least one straight edge for scrubbing along walls and said oscillating plate having at least one corner having an angle of 90° or less for scrubbing in corners, 2.) abrasive portion attachment means attached to said oscillating plate, and 3.) a plurality of skid plates attached to said oscillating plate, said plurality of oscillating plate skid plates positioned adjacent said plurality of stationary plate skid plates, said oscillating portion skid plates each having a longitudinal groove which slidably engages said longitudinal rails of said stationary portion skid plates, and d.) an abrasive portion removably attached to said abrasive portion attachment means of said oscillating portion.

11. The scrubbing device of claim 10 wherein said oscillating plate is rectangular.

12. The scrubbing device of claim 11 wherein said stationary plate is rectangular.

13. The scrubbing device of claim 10 wherein said abrasive portion attachment means are a plurality of members having a multitude of hooks.

14. The scrubbing device of claim 10 wherein said abrasive portion is constructed of plastic mesh.

* * * * *